US009263246B2

(12) United States Patent
Ohashi et al.

(10) Patent No.: US 9,263,246 B2
(45) Date of Patent: Feb. 16, 2016

(54) LAMP

(71) Applicant: Toshiba Lighting & Technology Corporation, Yokosuka, Kanagawa-ken (JP)

(72) Inventors: Tsuyoshi Ohashi, Yokosuka (JP); Masaaki Takatsuka, Yokosuka (JP); Yoshitaka Fujita, Yokosuka (JP)

(73) Assignee: Toshiba Lighting & Technology Corporation, Yokosuka-shi, Kanagawa-ken (JP)

( * ) Notice: Subject to any disclaimer, the term of this patent is extended or adjusted under 35 U.S.C. 154(b) by 0 days.

(21) Appl. No.: 14/606,574

(22) Filed: Jan. 27, 2015

(65) Prior Publication Data

US 2015/0279652 A1 Oct. 1, 2015

(30) Foreign Application Priority Data

Mar. 31, 2014 (JP) ..... 2014-073904

(51) Int. Cl.

| | |
|---|---|
| ***H01J 5/16*** | (2006.01) |
| ***H01K 1/32*** | (2006.01) |
| ***H01K 5/00*** | (2006.01) |
| ***H05B 3/00*** | (2006.01) |

(52) U.S. Cl.

CPC ..... *H01K 1/325* (2013.01); *H01K 5/00* (2013.01); *H05B 3/0033* (2013.01)

(58) Field of Classification Search

CPC ..... H01K 1/325; H01K 5/00

USPC ..... 313/113, 635, 493

See application file for complete search history.

(56) References Cited

U.S. PATENT DOCUMENTS

| | | | | |
|---|---|---|---|---|
| 5,982,969 | A * | 11/1999 | Sugiyama et al. | 385/123 |
| 5,991,080 | A | 11/1999 | Kohta et al. | |
| 2013/0214676 | A1* | 8/2013 | Li et al. | 313/512 |

FOREIGN PATENT DOCUMENTS

| | | | |
|---|---|---|---|
| CH | 452696 | A | 3/1968 |
| DE | 202013000527 | U1 | 8/2013 |
| EP | 0675522 | A2 | 10/1995 |
| JP | H07-230795 | A | 8/1995 |
| JP | 2000-123789 | A | 4/2000 |
| JP | 2005-032552 | A | 2/2005 |
| JP | 2012-135952 | A | 7/2012 |
| WO | 2006/054227 | A2 | 5/2006 |

OTHER PUBLICATIONS

Aug. 17, 2015—(EP) Extended Search Report—App 15151567.3.

* cited by examiner

*Primary Examiner* — Vip Patel
(74) *Attorney, Agent, or Firm* — Banner & Witcoff, Ltd.

(57) ABSTRACT

A lamp includes a bulb, a filament, a gas, and a reflective film. The filament is disposed in the interior of the bulb along the tube axis. The gas is filled in the interior of the bulb. The reflective film is formed on the outer circumferential surface of the bulb and reflects a light from the filament toward the interior of the bulb. Further, the reflective film may be formed by depositing a reflective film material containing $TiO_2$, $SiO_2$, and $BaSO_4$ on the outer circumferential surface of the bulb.

14 Claims, 4 Drawing Sheets

LAMP

CROSS-REFERENCE TO RELATED APPLICATION

This application is based upon and claims the benefit of priorities from Japanese Patent Application No. 2014-073904 filed on Mar. 31, 2014; the entire contents of which are incorporated herein by reference.

FIELD

Embodiments described herein relate generally to a lamp.

BACKGROUND

Heretofore, a lamp, for example, a halogen lamp is used as a halogen heater that heats an irradiation target body. The halogen heater is used for, for example, heating a preform in a process for molding a PET bottle or heating a resin which is a material in a process for molding a resin.

Meanwhile, when the halogen lamp is used as a halogen heater, many halogen lamps are sometimes used in one facility. In such a case, for the purpose of energy saving, the consumption of electric power used in the facility is required to be reduced. In order to meet this requirement, the improvement of lamp efficiency is demanded.

An object of the exemplary embodiments is to provide a lamp having an increased irradiation intensity.

DETAILED DESCRIPTION

Figure 1:
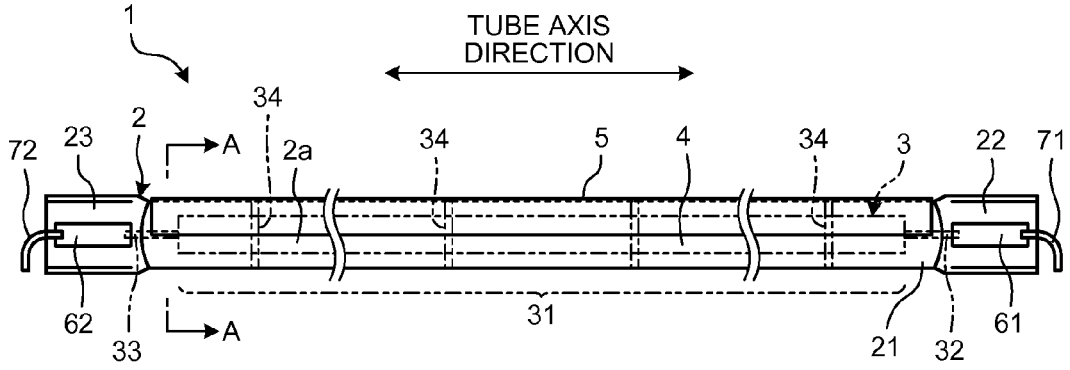
FIG. 1 is a front view showing a lamp according to an embodiment.

A lamp 1 according to an embodiment described below includes a bulb 2, a filament 3, a gas 4, and a reflective film 5. The filament 3 is disposed in the interior 2*a* of the bulb 2 along the tube axis. The gas 4 is filled in the interior 2*a* of the bulb 2. The reflective film 5 is formed on the outer circumferential surface 2*b* of the bulb 2 and reflects a light from the filament 3 toward the interior 2*a* of the bulb 2. Further, the reflective film 5 contains $TiO_2$, $SiO_2$, and $BaSO_4$.

Further, in the lamp 1 according to the embodiment described below, the reflective film 5 is formed by depositing a reflective film material on the outer circumferential surface 2*b* of the bulb 2. The reflective film material contains $TiO_2$ (33.7 wt % to 54.5 wt %) and $BaSO_4$ (6.8 wt % to 18.1 wt %).

Further, in the lamp 1 according to the embodiment described below, the reflective film material is configured such that a particle size a1 at the first peak in the particle size distribution of $BaSO_4$ is smaller than a particle size a2 at the second peak in the particle size distribution of $TiO_2$.

Further, in the lamp 1 according to the embodiment described below, the particle size a1 (μm) at the first peak in the particle size distribution satisfies the following formula: $0.1 \leq a1 \leq 1$, and the particle size a2 (μm) at the second peak in the particle size distribution satisfies the following formula: $1 < a2 \leq 20$.

Further, in the lamp 1 according to the embodiment described below, the reflective film material is configured such that the occupancy of particles having the particle size a1 at the first peak is higher than the occupancy of particles having the particle size a2 at the second peak.

Further, in the lamp 1 according to the embodiment described below, the reflective film material is configured such that the occupancy of particles having the particle size a1 at the first peak is three to four times higher than the occupancy of particles having the particle size a2 at the second peak.

Further, in the lamp 1 according to the embodiment described below, the bulb 2 includes a cylindrical section 21 in which an internal space is formed, and seal sections 22 and 23 disposed on both ends of the cylindrical section 21 in the tube axis direction. The reflective film 5 is formed in a region of the cylindrical section 21 in the outer circumferential surface 2*b* of the bulb 2.

Further, in the lamp 1 according to the embodiment described below, the reflective film 5 is formed into an arc shape along the outer circumferential surface 2*b* of the bulb 2 when seen in the tube axis direction.

Further, in the lamp 1 according to the embodiment described below, the bulb 2 is formed into a linear shape. A region where the reflective film 5 covers the outer circumferential surface 2*b* of the bulb 2 has a film angle which is an angle with respect to the axial center of the bulb 2 of 170° to 230°.

Further, in the lamp 1 according to the embodiment described below, the gas 4 contains at least one of krypton, xenon, argon, and neon.

Further, in the lamp 1 according to a first modification and a second modification described below, the both ends 2*d* and 2*e* of the bulb 2 are formed so as to be bent at 90° with respect to the tube axis direction.

Further, in the lamp 1 according to the first modification described below, the bulb 2 has a chip 2*f* protruding from a portion of the outer circumferential surface 2*b* at the center in the tube axis direction. The reflective film 5 is formed so as to cover a part of the chip 2*f*.

Further, in the lamp 1 according to the first modification described below, a region where the reflective film 5 covers the outer circumferential surface 2*b* of the bulb 2 in the bent portion of each of both ends 2*d* and 2*e* of the bulb 2 has a film angle which is an angle with respect to the axial center of the bulb 2 of 70° to 110°.

Further, in the lamp 1 according to the second modification described below, the bulb 2 has a chip 2*f* protruding from a portion of the outer circumferential surface 2*b* at the center in the tube axis direction. The reflective film 5 is formed on the side facing the chip 2*f*.

Further, in the lamp 1 according to the second modification described below, a region where the reflective film 5 covers the outer circumferential surface 2*b* of the bulb 2 in the bent portion of each of both ends 2*d* and 2*e* of the bulb 2 has a film angle which is an angle with respect to the axial center of the bulb 2 of 170° to 230°.

EMBODIMENTS

Figure 2:
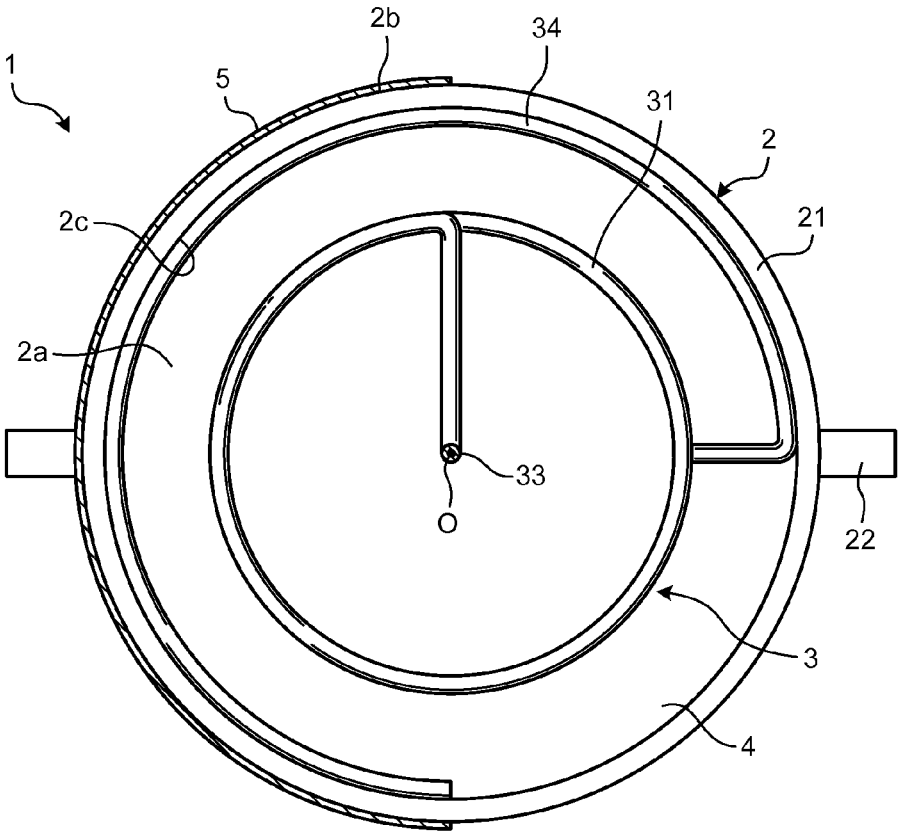
FIG. 2 is a cross-sectional view showing the lamp according to the embodiment.
Figure 3:
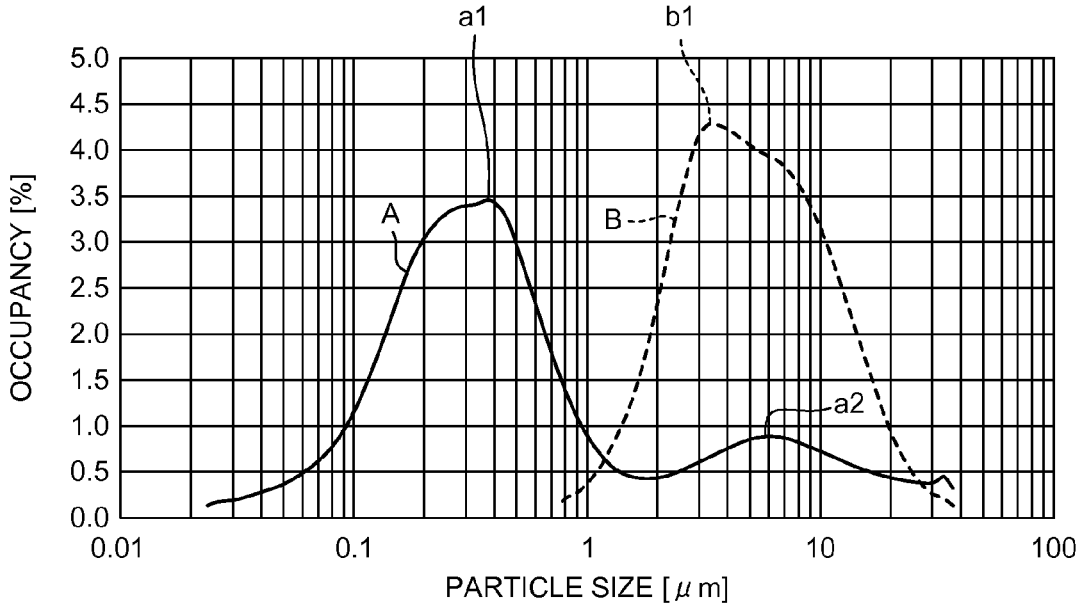
FIG. 3 is an explanatory view showing a particle size distribution.

Embodiments will be described with reference to FIGS. 1 and 2. FIG. 1 is a front view showing a lamp according to the embodiment. FIG. 2 is a cross-sectional view showing the lamp according to the embodiment. FIG. 3 is an explanatory view showing a particle size distribution. Incidentally, FIG. 1 is a view in which a part of the lamp in the tube axis direction is omitted. FIG. 2 is a cross-sectional view taken along the line A-A of FIG. 1. Incidentally, the particle size distribution shown in FIG. 3 was measured using Microtrac MT-3000, manufactured by Microtrac, Inc.

The lamp according to this embodiment provides heat to an irradiation target body or an irradiation target space to be heated, and as an example, the lamp is supposed to be used in an irradiation apparatus that heats a preform in a process for molding a PET bottle or an irradiation apparatus that heats a resin which is a material in a process for molding a resin. As shown in FIG. 1, a lamp 1 is configured to include a bulb 2, a filament 3, a gas 4, a reflective film 5, metal foils 61 and 62, and outer leads 71 and 72. Incidentally, in the lamp 1, a lamp power is from 1500 W to 2500 W.

The bulb 2 transmits an internal light to the outside and is configured to include a cylindrical section 21, and seal sections 22 and 23. The bulb 2 is formed from, for example, quartz glass, and is transparent and colorless, and is a long object in which the total length is longer than the tube diameter.

In the cylindrical section 21, an interior 2*a* is formed as an internal space, and the filament 3 is disposed in the interior 2*a*.

The seal sections 22 and 23 are disposed at both ends of the cylindrical section 21 in the tube axis direction, respectively. The seal sections 22 and 23 are sealing members and seal the cylindrical section 21. The seal sections 22 and 23 in this embodiment are formed into a plate shape by a pinch seal. Incidentally, the seal sections 22 and 23 may be formed into a cylindrical shape by a shrink seal.

Incidentally, in the bulb 2, a chip (not shown) is formed. The chip is a burnt trace of an exhaust tube provided for evacuation of the interior 2*a* and introduction of the gas 4 when the lamp 1 is produced. The chip is closed when the lamp 1 is completed. Further, in the bulb 2, a dimple (not shown) may be formed. The dimple regulates the rotation in the circumferential direction of the filament 3 with respect to the bulb 2 or the movement thereof in the tube axis direction, and prevents the formation of a dense region and a sparse region of the filament 3 in the tube axis direction. The dimple is formed so as to protrude toward the interior 2*a* of the bulb 2 on the outer circumferential surface 2*b* of the bulb 2. At least one dimple may be formed, however, in order to regulate the movement of the filament 3 according to the shapes of the bulb 2 and the filament 3, two or more dimples may be formed.

The filament 3 is disposed in the interior 2*a* of the bulb 2 along the tube axis, and is formed integrally with a main section 31, leg sections 32 and 33, and an anchor 34. The filament 3 in this embodiment is a metal wire made of tungsten.

The main section 31 is a portion that generates heat and emits a light when the lamp is turned on, and is disposed in the interior 2*a* of the bulb 2. The main section 31 is formed by winding a metal wire. As shown in FIG. 2, the main section 31 is formed into a circular shape when seen in the tube axis direction. That is, the main section 31 is formed into a cylindrical shape.

The leg sections 32 and 33 are disposed at both ends of the main section 31 in the tube axis direction, and partially embedded in the seal sections 22 and 23, respectively. The leg sections 32 and 33 are portions that supply electric power to the main section 31. The leg sections 32 and 33 are connected through one end thereof to both ends of the main section 31, respectively, and are electrically connected through the other end thereof to the metal foils 61 and 62, respectively.

The anchor 34 is a support member for the main section 31, and is configured as a separate member from the main section 31 and the legs sections 32 and 33. The anchor 34 is connected to the main section 31 by winding one end thereof around the main section 31 several turns. The anchor 34 is configured such that the central portion thereof is formed toward the inner wall 2*c* of the bulb 2. The anchor 34 is formed into an arc shape along the inner wall 2*c* when the other end thereof is seen in the tube axis direction. A plurality of anchors 34 are provided in the tube axis direction so as to maintain one or more predetermined pitches and support the main section 31 of the filament 3 so that the main section 31 is disposed substantially at the center of the interior 2*a* of the bulb 2.

The gas 4 is filled in the interior 2*a* of the bulb 2. The gas 4 in this embodiment is argon gas at about 0.8 atm containing a trace amount of dibromomethane ($CH_2Br_2$). Incidentally, the gas 4 is preferably a gas having low thermal conductivity, and specifically, may be configured to contain one type of gas selected from krypton, xenon, argon, neon, and the like, or two or more types of gases in combination. Further, the gas 4 may be configured to contain one type of halogen selected from bromine, iodine, and the like, or two or more types of halogens in combination.

The reflective film 5 is formed on the outer circumferential surface 2*b* of the bulb 2. The reflective film 5 is formed in a region of the cylindrical section 21 in the outer circumferential surface 2*b*. The reflective film 5 is formed into an arc shape along the outer circumferential surface 2*b* when seen in the tube axis direction. The reflective film 5 reflects a light from the filament 3 toward the interior 2*a* of the bulb 2. That is, the reflective film 5 reflects a part of a light transmitted from the filament 3 through the bulb 2 and irradiated to the outside of the bulb 2 toward the interior 2*a* of the bulb 2. Incidentally, a region where the reflective film 5 covers the outer circumferential surface 2*b* of the bulb 2 when seen in the tube axis direction is arbitrarily determined. A region where the reflective film 5 covers the outer circumferential surface 2*b* of the bulb 2 in the lamp 1 in which the bulb 2 is in a linear shape preferably has an angle with respect to the axial center O of the bulb 2 (film angle) of 170° to 230°. The reflective film 5 in this embodiment has a film angle of 180°.

The reflective film 5 contains $TiO_2$ (titanium oxide), $SiO_2$ (silicon oxide), and $BaSO_4$ (barium sulfate). The reflective film 5 is formed by depositing a reflective film material on the outer circumferential surface 2*b* of the bulb 2. That is, the starting material of the reflective film 5 contains $TiO_2$, $SiO_2$, and $BaSO_4$. In this embodiment, the reflective film material contains $TiO_2$ (33.7 wt % to 54.5 wt %) and $BaSO_4$ (6.8 wt % to 18.1 wt %) in terms of weight ratio after drying a coating film (100 wt %). Here, the reflective film material is composed of particles having different particle sizes. As shown in FIG. 3, the reflective film material has two peaks a1 and a2 in the particle size distribution (A in FIG. 3). The first peak a1 appears on the small particle size side in the particle size range of 0.1 μm or more and 1 μm or less. The second peak a2 appears on the large particle size side in the particle size range of more than 1 μm and 20 μm or less. Further, in the reflective film material, the occupancy at the peak a1 on the small particle size side is higher than the occupancy at the peak a2 on the large particle size side, and the occupancy at the peak a1 is three to four times higher than the occupancy at the peak a2. That is, the reflective film material is mainly occupied by a material having a small particle size, and partially contains a material having a large particle size. Incidentally, the reflective film 5 is formed by repeatedly applying a liquid containing the reflective film material on the outer circumferential surface 2*b* of the bulb 2 to form a film having a predetermined thickness, and then, applying an electric current to the lamp 1 and firing the film by heat radiation from the filament 3. Here, if the content of $TiO_2$ is less than 33.7 wt %, the ratio of particles on the small particle size side decreases so that gaps between particles cannot be sufficiently filled, and therefore, the reflection efficiency is lowered. On the other hand, if the content of $TiO_2$ exceeds 54.5 wt %, a crack easily occurs in the reflective film 5 from the viewpoint of the production process, and therefore, the production of the film becomes difficult. Further, if the content of $BaSO_4$ is less than 6.8 wt %, the ratio of $BaSO_4$ having a high reflectance decreases, and therefore, the reflection efficiency is lowered. On the other hand, if the content of $BaSO_4$ exceeds 18.1 wt %, the ratio of particles on the large particle size side increases so that the size of gaps between particles becomes too large and the transmitted light increases, and therefore, the reflection efficiency is lowered. Incidentally, $SiO_2$ is a binder. That is, if the reflective film material is composed only of $TiO_2$ and $BaSO_4$, even if the material is applied to the outer circumferential surface 2*b* of the bulb 2, the reflective film 5 is peeled off after firing. Further, by incorporating $SiO_2$ in the reflective film material, $SiO_2$ interacts with $TiO_2$ or $BaSO_4$, and therefore, when the reflective film 5 is formed, the reflective film 5 can be retained on the outer circumferential surface 2*b* of the bulb 2.

The metal foils 61 and 62 are connected through one end thereof to the leg sections 32 and 33 of the filament 3, respectively, and are connected through the other end thereof to the outer leads 71 and 72, respectively. The metal foils 61 and 62 are embedded in the seal sections 22 and 23, respectively. The metal foils 61 and 62 in this embodiment are each a molybdenum foil, and are disposed along the plate-shaped surfaces of the seal sections 22 and 23, respectively.

The outer leads 71 and 72 connect an external power source (not shown) to the metal foils 61 and 62, respectively. The outer leads 71 and 72 are connected through one end thereof to the metal foils 61 and 62, respectively, and the other ends thereof are exposed to the outside of the bulb 2. The outer leads 71 and 72 are partially embedded in the seal sections 22 and 23, respectively. Each of the other ends of the outer leads 71 and 72 is inserted into a connector (not shown) along with the seal section 22 or 23, and is electrically connected to a cable (not shown) provided for the connector, and connected to a power source through the cable. The outer leads 71 and 72 are each a molybdenum rod.

Figure 4:
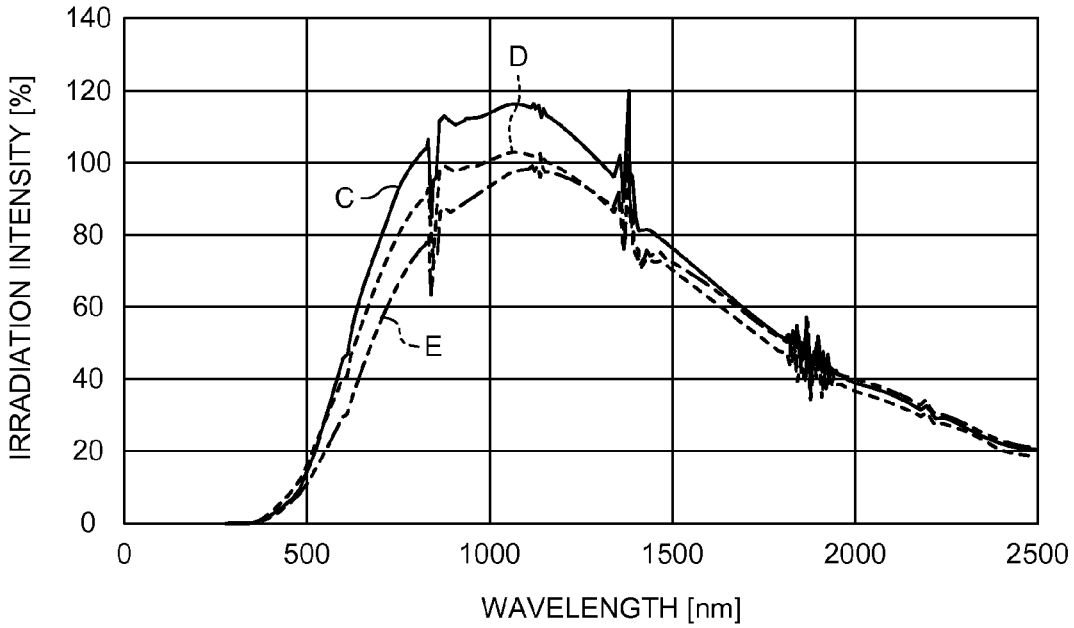
FIG. 4 is an explanatory view showing a relationship between the wavelength and the irradiation intensity.

Hereinafter, the test results of the lamp 1 and Conventional Products 1 and 2 will be shown. FIG. 4 is an explanatory view showing a relationship between the wavelength and the irradiation intensity. Incidentally, the "irradiation intensity" is obtained by spectroscopy, and the results in this test are expressed as the light intensities of the lamp 1 and Conventional Products 1 and 2 when the spectral intensity of Conventional Product 1 at a wavelength of 1000 nm is used as a reference (100%). Specifically, the measurement is performed using MSR-7000N manufactured by Opto Research Corporation.

The conditions including total length, tube diameter, inner diameter, effective light emission length, lamp power, and shape (including film thickness and film angle) of the reflective film 5 are the same for "Present Inventive Product", which is the lamp 1, and "Conventional Product 1", and "Conventional Product 2", and the reflective film material of the reflective film 5 is different.

The reflective film material of "Present Inventive Product" contains $TiO_2$ (38 wt %), $BaSO_4$ (15 wt %), and $SiO_2$ (47 wt %) in terms of weight ratio after drying a coating film (100 wt %). The reflective film material of "Conventional Product 1" contains $Al_2O_3$ (aluminum oxide, 35 wt %), ZrO (zirconium oxide, 23 wt %), and $SiO_2$ (42 wt %) in terms of weight ratio after drying a coating film (100 wt %). The reflective film material of "Conventional Product 2" contains BN (boron nitride, 78 wt %) and $Al_2O_3$ (22 wt %) in terms of weight ratio after drying a coating film (100 wt %).

Further, as shown in FIG. 3, the reflective film material of "Present Inventive Product" has two peaks a1 and a2 at about 0.3 μm and about 5 μm in the particle size distribution (A in FIG. 3), and is mainly occupied by a material having a small particle size, and partially contains a material having a large particle size. The reflective film material of "Conventional Product 1" has one peak b1 at about 2.5 μm in the particle size distribution (B in FIG. 3), and is mainly occupied by a material having a large particle size.

As shown in FIG. 4, in the case of "Present Inventive Product" (C in FIG. 4), the irradiation intensity can be increased in the wavelength range of 600 nm to 1800 nm as compared with the case of "Conventional Product 1" (D in FIG. 4), and particularly, the irradiation intensity can be increased by about 14% at a wavelength of around 1000 nm. Further, in the case of "Present Inventive Product", the irradiation intensity can be increased in the wavelength range of 400 nm to 2500 nm as compared with "Conventional Product 2" (E in FIG. 4), and particularly the irradiation intensity can be increased by about 17% at a wavelength of around 1000 nm. That is, in the case of the lamp 1 of "Present Inventive Product" in which the reflective film 5 composed of $TiO_2$, $SiO_2$, and $BaSO_4$ is formed, the irradiation intensity can be increased as compared with the case of the lamps of "Conventional Product 1" and "Conventional Product 2" in which a reflective film mainly contains $Al_2O_3$ or BN and containing no $TiO_2$ or $BaSO_4$ is formed. Therefore, the reflective film 5 in "Present Inventive Product" has higher reflection efficiency than the reflective films in "Conventional Product 1" and "Conventional Product 2" in which the type of material used as the reflective film material is different. Further, in the case of the lamp 1 of "Present Inventive Product" having the reflective film 5 formed by using the reflective film material, in which the particle size distribution has two peaks a1 and a2, and the occupancy at the peak a1 on the small particle size side is higher than the occupancy at the peak a2 on the large particle size side, the irradiation intensity can be increased as compared with the case of the lamp of "Conventional Product 1" having the reflective film formed by using the reflective film material, in which the particle size distribution has one peak b1, and the peak b1 appears on the large particle size side similarly to the peak a2. Accordingly, the reflective film 5 in "Present Inventive Product" has higher reflection efficiency than the reflective film in "Conventional Product 1", which has a different peak in the particle size distribution.

As described above, in the case of the lamp 1 according to this embodiment, by forming the reflective film 5 from $TiO_2$, $SiO_2$, and $BaSO_4$, the reflection efficiency of the reflective film 5 is improved as compared with a reflective film which does not contain $TiO_2$ or $BaSO_4$, and therefore, the irradiation intensity can be increased. Therefore, as compared with a lamp having a reflective film which does not contain $TiO_2$ or $BaSO_4$, the consumption of electric power required for obtaining the same irradiation intensity can be reduced. Accordingly, the consumption of electric power in a facility using many lamps in the production process can be largely reduced, and thus, energy saving can be achieved.

Further, since the reflective film material for forming the reflective film 5 contains $TiO_2$ (33.7 wt % to 54.5 wt %) and $BaSO_4$ (6.8 wt % to 18.1 wt %), both of the improvement of reflection efficiency as compared with reflective films formed outside the above-described numerical ranges and the prevention of occurrence of a crack when firing the reflective film can be achieved.

Further, the reflective film 5 is formed by depositing the reflective film material, in which the particle size a1 at the first peak in the particle size distribution of $BaSO_4$ is smaller than the particle size a2 at the second peak in the particle size distribution of $TiO_2$, on the outer circumferential surface 2*b* of the bulb 2, and therefore, a sparse region and a dense region are distributed in the reflective film 5. If the reflective film material is composed only of a material having a small particle size, the reflective film is constituted only by a dense region, and therefore, the reflection efficiency can be improved. However, since the fluidity of the reflective film material is low, a crack occurs when firing the reflective film. On the other hand, if the reflective film material is composed only of a material having a large particle size, the reflective film is constituted only by a sparse region, and therefore, the improvement of reflection efficiency cannot be expected. However, since the fluidity of the reflective film material is high, the occurrence of a crack is prevented when firing the reflective film. When a sparse region and a dense region are distributed in the reflective film 5, both of the improvement of reflection efficiency and the prevention of occurrence of a crack when firing the reflective film can be achieved.

Further, since the reflective film 5 is formed by depositing the reflective film material, in which the particle size a1 (μm) at the first peak in the particle size distribution satisfies the following formula: $0.1 \leq a1 \leq 1$, and the particle size a2 (μm) at the second peak in the particle size distribution satisfies the following formula: $1 < a2 \leq 20$, on the outer circumferential surface 2*b* of the bulb 2, the distribution of a sparse region and a dense region in the reflective film 5 is further enhanced, and thus, both of the improvement of reflection efficiency and the prevention of occurrence of a crack when firing the reflective film can be achieved.

Figure 5:
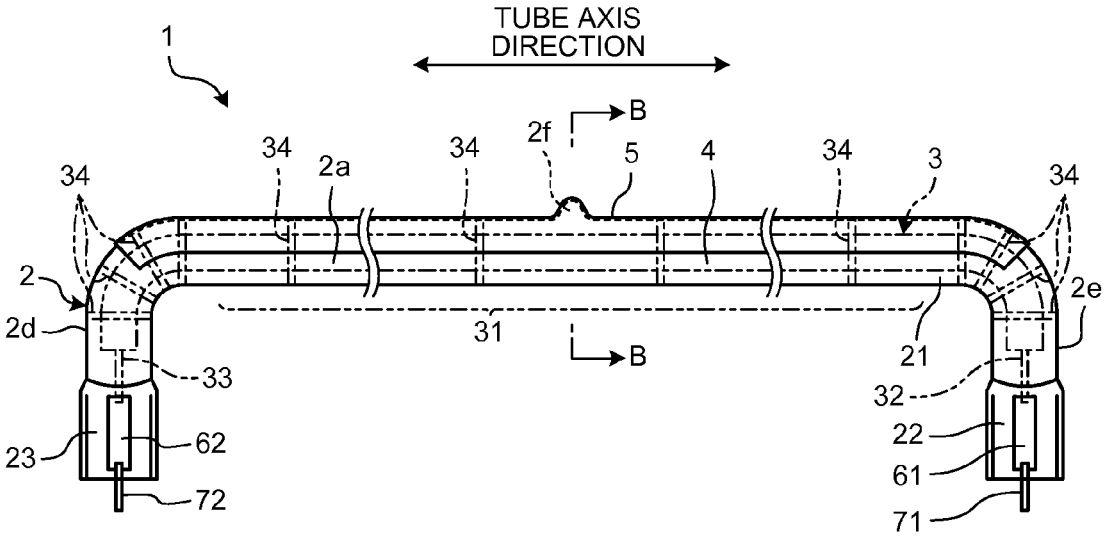
FIG. 5 is a front view showing a first modification of the lamp according to the embodiment.
Figure 6:
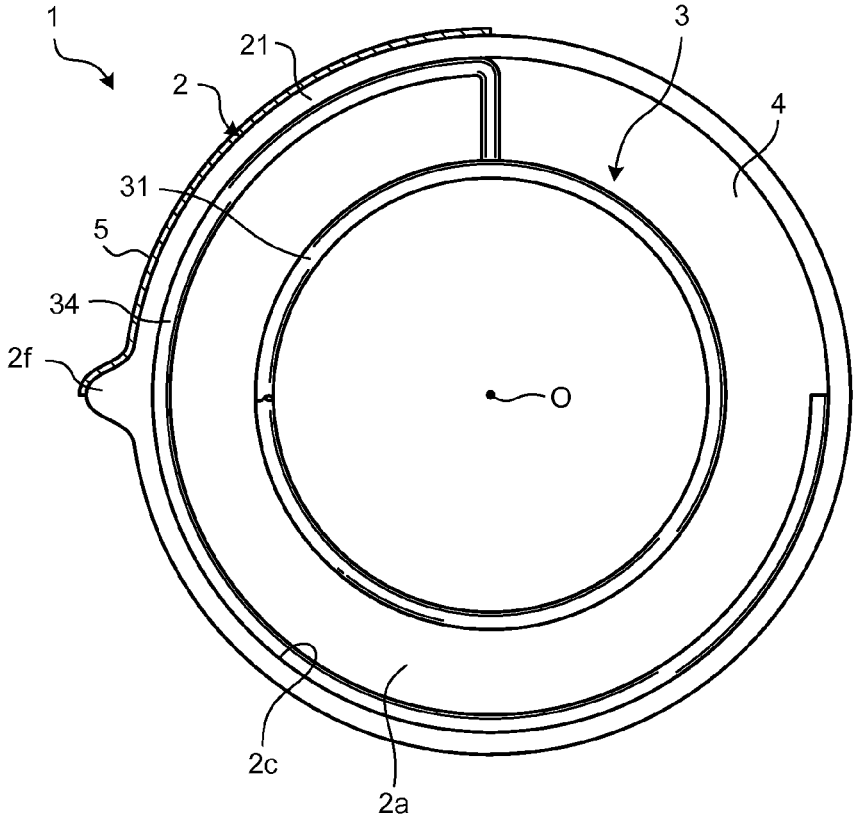
FIG. 6 is a schematic cross-sectional view showing the first modification of the lamp according to the embodiment.
Figure 7:
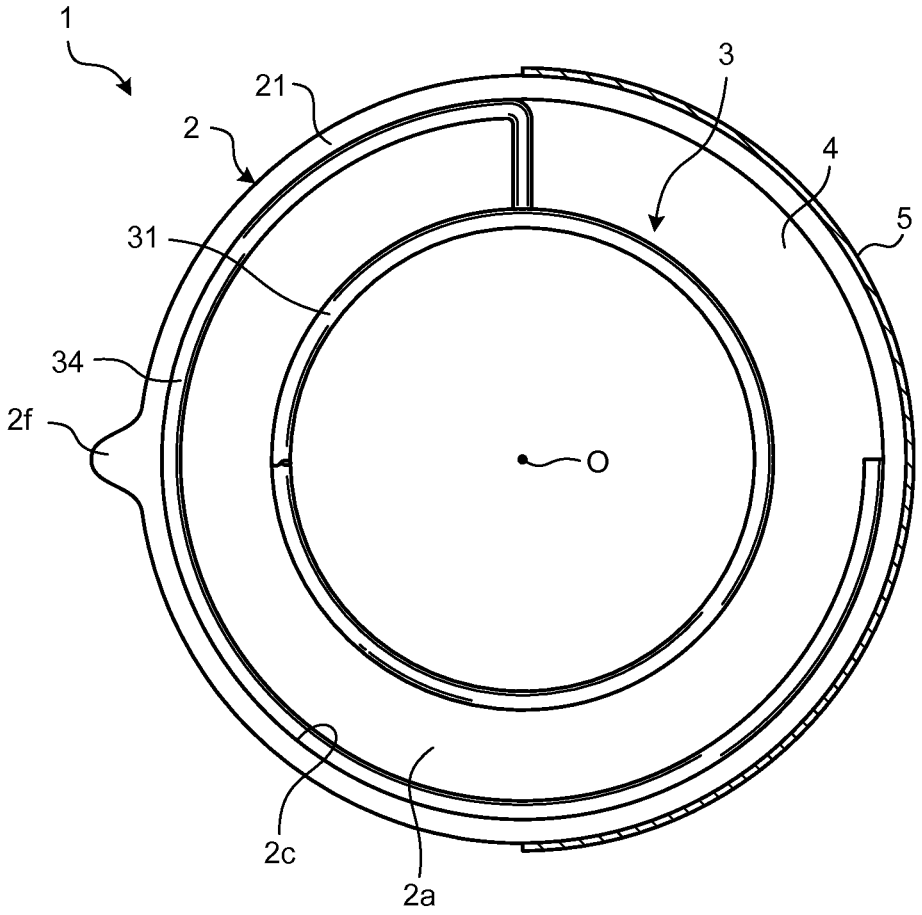
FIG. 7 is a schematic cross-sectional view showing a second modification of the lamp according to the embodiment.

Incidentally, the lamp 1 according to this embodiment is formed into a linear shape, but is not limited thereto. FIG. 5 is a front view showing a first modification of the lamp according to the embodiment. FIG. 6 is a schematic cross-sectional view showing the first modification of the lamp according to the embodiment. FIG. 7 is a schematic cross-sectional view showing a second modification of the lamp according to the embodiment. Incidentally, FIG. 5 is a view in which a part of the lamp in the tube axis direction is omitted. FIG. 6 is a cross section taken along the line B-B of FIG. 5, and is a view in which a part behind the cross section is omitted.

As the first modification shown in FIGS. 5 and 6, the lamp 1 may be configured such that both ends 2*d* and 2*e* of the bulb 2 are bent. Each of both ends 2*d* and 2*e* in the first modification is formed so as to be bent at 90° with respect to the tube axis direction. Incidentally, a reference symbol 2*f* denotes a chip. The both ends of the main section 31 of the filament 3 are also bent following the both ends 2*d* and 2*e* of the bulb 2 and placed in the interior 2*a*. The reflective film 5 in the first modification is formed so as to cover a part of the chip 2*f* and has a film angle of 90°. Incidentally, a region where the reflective film 5 covers the outer circumferential surface 2*b* of the bulb 2 in the lamp 1 in a bent shape in which both ends 2*d* and 2*e* of the bulb 2 are bent preferably has a film angle of 70° to 110°. Further, as the second modification shown in FIG. 7, the reflective film 5 is formed on the side facing the chip 2*f*, and may have a film angle of 180°. In this case, a region where the reflective film 5 covers the outer circumferential surface 2*b* of the bulb 2 in the lamp 1 in a bent shape in which both ends 2*d* and 2*e* of the bulb 2 are bent preferably has a film angle of 170° to 230°.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A lamp, comprising:

a bulb;

a filament disposed in an interior of the bulb along a tube axis;

a gas filled in the interior of the bulb; and a reflective film formed on an outer circumferential surface of the bulb and reflecting a light from the filament toward the interior of the bulb, wherein the reflective film is formed by depositing a reflective film material on the outer circumferential surface of the bulb, and wherein the reflective film contains 33.7 wt % to 54.5 wt % $TiO_2$, $SiO_2$, and 6.8 wt % to 18.1 wt % $BaSO_4$.

2. The lamp according to claim 1, wherein the reflective film material is configured such that a particle size a1 at a first peak in a particle size distribution of $BaSO_4$ is smaller than a particle size a2 at a second peak in a particle size distribution of $TiO_2$.

3. The lamp according to claim 2, wherein the particle size a1 (μm) at the first peak in the particle size distribution satisfies the following formula: $0.1 \leq a1 \leq 1$, and the particle size a2 (μm) at the second peak in the particle size distribution satisfies the following formula: $1 < a2 \leq 20$.

4. The lamp according to claim 2, wherein the reflective film material is configured such that an occupancy of particles having the particle size a1 at the first peak is higher than an occupancy of particles having the particle size a2 at the second peak.

5. The lamp according to claim 2, wherein the reflective film material is configured such that an occupancy of particles having the particle size a1 at the first peak is three to four times higher than an occupancy of particles having the particle size a2 at the second peak.

6. The lamp according to claim 1, wherein the bulb includes a cylindrical section in which an internal space is formed, and seal sections disposed on both ends of the cylindrical section in a direction of the tube axis, and the reflective film is formed in a region of the cylindrical section in the outer circumferential surface of the bulb.

7. The lamp according to claim 1, wherein the reflective film is formed into an arc shape along the outer circumferential surface of the bulb when seen in a direction of the tube axis.

8. The lamp according to claim 1, wherein the bulb is formed into a linear shape, and a region where the reflective film covers the outer circumferential surface of the bulb has a film angle which is an angle with respect to an axial center of the bulb of 170° to 230°.

9. The lamp according to claim 1, wherein the gas contains at least one of krypton, xenon, argon, and neon.

10. The lamp according to claim 1, wherein each of both ends of the bulb is formed so as to be bent at 90° with respect to a direction of the tube axis.

11. The lamp according to claim 10, wherein the bulb has a chip protruding from a portion of the outer circumferential surface at the center in the direction of the tube axis, and the reflective film is formed so as to cover a part of the chip.

12. The lamp according to claim 11, wherein a region where the reflective film covers the outer circumferential surface of the bulb in a bent portion of each of both ends of the bulb has a film angle which is an angle with respect to an axial center of the bulb of 70° to 110°.

13. The lamp according to claim 10, wherein the bulb has a chip protruding from a portion of the outer circumferential surface at the center in the direction of the tube axis, and the reflective film is formed on a side of the outer circumferential surface facing the chip.

14. The lamp according to claim 13, wherein a region where the reflective film covers the outer circumferential surface of the bulb in a bent portion of each of both ends of the bulb has a film angle which is an angle with respect to an axial center of the bulb of 170° to 230°.

* * * * *